US006296690B1

(12) United States Patent
Charron

(10) Patent No.: US 6,296,690 B1
(45) Date of Patent: Oct. 2, 2001

(54) COMPRESSION-PUMPING SYSTEM COMPRISING AN ALTERNATING COMPRESSION SECTION AND ITS PROCESS

(75) Inventor: Yves Charron, Longpont sur Orge (FR)

(73) Assignee: Institut Francais du Petrole (FR)

( * ) Notice: Subject to any disclaimer, the term of this patent is extended or adjusted under 35 U.S.C. 154(b) by 0 days.

(21) Appl. No.: 09/404,655

(22) Filed: Sep. 24, 1999

(30) Foreign Application Priority Data

Sep. 24, 1998 (FR) ..... 98 11990

(51) Int. Cl.[7] ..... B01D 19/00

(52) U.S. Cl. ..... 95/248; 95/254; 95/261; 96/158; 96/163; 96/167; 96/196; 96/216

(58) Field of Search ..... 95/247, 248, 254, 95/261, 266; 96/193, 194, 196, 216, 157, 158, 162, 163, 169, 167, 168

(56) References Cited

U.S. PATENT DOCUMENTS

| | | | | |
|---|---|---|---|---|
| 1,387,748 | * | 8/1921 | Wilson | 96/158 |
| 2,005,466 | * | 6/1935 | La Bour | 95/261 |
| 2,213,857 | * | 9/1940 | Griffith | 96/168 |
| 2,552,264 | * | 5/1951 | Edwards | 96/196 |
| 3,050,008 | * | 8/1962 | Pacey et al. | 96/163 |
| 3,366,061 | | 1/1968 | Adams . | |
| 4,273,562 | * | 6/1981 | Niskanen | 95/261 |
| 4,435,193 | * | 3/1984 | Gullichsen et al. | 95/261 |
| 4,600,413 | * | 7/1986 | Sugden | 95/261 |
| 4,921,400 | * | 5/1990 | Niskanen | 95/261 |
| 5,375,976 | | 12/1994 | Arnaudeau . | |
| 6,139,606 | * | 10/2000 | Forslund et al. | 95/243 |

FOREIGN PATENT DOCUMENTS

| | | |
|---|---|---|
| 549439 | 6/1993 | (EP) . |
| 2665224 | 11/1992 | (FR) . |
| 2774136 | 2/2000 | (FR) . |
| 2014862 | 9/1979 | (GB) . |
| 2273958 | 7/1994 | (GB) . |
| 8703051 | 5/1987 | (WO) . |

* cited by examiner

*Primary Examiner*—Duane S. Smith
(74) *Attorney, Agent, or Firm*—Antonelli, Terry, Stout & Kraus, LLP

(57) ABSTRACT

An alternating compression-pumping system includes at least one alternating compression-pumping section, suited to impart a pressure value to an essentially liquid fluid or to an essentially gaseous fluid, at least one pumping section suited for an essentially fluid, at least one device for separating the various phases of the fluid, provided with a level detector allowing to detect the gas-liquid interface level, valves allowing to control the flow rate of the liquid or gas phases, and a control system allowing to vary the state of the valves so as to shift the compression section from an operating mode suited for gas to an operating mode suited for liquid and vice versa.

15 Claims, 4 Drawing Sheets

COMPRESSION-PUMPING SYSTEM COMPRISING AN ALTERNATING COMPRESSION SECTION AND ITS PROCESS

FIELD OF THE INVENTION

The present invention relates to an alternating compression-pumping system intended for a multiphase fluid having a composition that can vary with time. The composition can successively comprise a large amount of gas, established over a long period of use, but also a low proportion of gas over a period that can lead to choking of a separator arranged upstream from the part of the system whose function is to impart energy to the fluid.

The system according to the invention notably finds applications in the field of petroleum production.

BACKGROUND OF THE INVENTION

Although the term "two-phase pumping" is commonly used to designate energy supply to a fluid consisting of a liquid phase and of a gas phase, we will use in the description hereafter the term "compression", that is better suited to designate energy transfer to a compressible two-phase fluid, especially when it is characterized by a high gas/liquid volume ratio (GLR under real temperature and pressure conditions).

Various devices, some examples of which are mentioned hereafter, allow to compress a two-phase fluid consisting of a gas and of a liquid, and possibly of solid particles:

- a series of single-phase machines (consisting at least of a pump and of a compressor) preceded by a separation system. This production mode leads to bulky and expensive compression installations,
- using radial impellers to directly compress a gas-liquid mixture. These impellers are limited to gas ratios generally lower than 20%. This limit can be extended to about 30% by using radio-axial impellers and beyond with axial impellers,
- positive-displacement machines (reciprocating, screw, membrane machines) allow to obtain a good compression efficiency for a two-phase mixture. On the other hand, they are very ill-suited to the high volume flow rates that characterize applications with high gas ratios,
- rotodynamic devices with helico-axial impellers, such as those described in the claimant's patent FR-2,665,224; the latter are particularly well-suited for compression of a two-phase mixture having a high volume flow rate. On the other hand, the low manometric head produced by each impeller does not allow to obtain very high compression ratios when the GLR is above 20. Furthermore, the efficiency of these impellers is lower than the efficiency of single-phase machines and it tends to decrease when the input pressure decreases,
- devices using dynamic separators upstream from a dry gas compressor, such as the gaseous fluid compressor associated with a gas-liquid separator described in patent application WO-87/03,051.

SUMMARY OF THE INVENTION

The present invention relates to a compression system that comprises at least one compression section, capable of accepting gas or liquid and of imparting an energy value to each of these fluids.

The compression system comprises means allowing this compression section to be shifted from gas mode to liquid mode and vice versa.

The present invention relates to an alternating compression-pumping system allowing to impart energy to a multiphase fluid having a composition that can vary with time, for example a variation in the amount of gas phase and in the amount of liquid phase.

It is characterized in that it comprises in combination at least the following elements:

- at least one alternating compression-pumping section, suited to impart a pressure value to an essentially liquid fluid or to an essentially gaseous fluid, the compression-pumping section comprising at least one line for delivering an essentially liquid phase, at least one line for delivering an essentially gaseous phase, at least one line intended for discharge of a gas that has acquired a certain energy after passing through the system, and at least one line intended for discharge of a liquid that has acquired a certain energy after passing through the compression-pumping section,
- at least one pumping section selected to impart energy to an essentially liquid fluid, the pumping section comprising at least one line for delivering an essentially liquid phase and at least one line for discharge of the liquid phase pumped,
- at least one device for separating the various phases that constitute the multiphase fluid, the separation device being connected to a multiphase fluid delivery line and to the line intended for discharge of the liquid coming from the alternating compression-pumping section, the device comprising at least one gas phase discharge line and at least one liquid phase discharge line,
- the separation device is provided with means ($C_L$) allowing to detect the gas-liquid interface level of the fluid introduced in the separation device,
- means (Vgi, Vli) allowing to control the flow rate of the liquid or gas phases in the Bvarious lines,
- control means allowing to vary the state of the flow rate control means so as to shift the compression section from an operating mode suited to gas to an operating mode suited to liquid and vice versa.

The compression system can comprise at least one line for recycling at least a fraction of the essentially gaseous fluid from the compression-pumping section to the separation device.

The system comprises for example a line for recycling at least a fraction of the essentially liquid fluid from the pumping section to the separation device.

The separation device can be associated with at least one of the following elements:

- a helical line intended to separate the liquid droplets from the gas phase,
- a series of disks mounted on the shaft, the shaft extending in the separator.

According to an embodiment, the compression section comprises for example at least one stage allowing to obtain separation of the gas phase and of the liquid phase occurring in the form of droplets.

The present invention also relates to a process allowing to impart energy to each of the phases of a multiphase fluid, the fluid comprising at least a liquid phase and at least a gas phase, knowing that the amount of the essentially liquid phase and the amount of the essentially gaseous phase can vary with time, the gas phase being sent to a compression-pumping section and the liquid phase being sent to a pumping section or to an alternating compression-pumping section, the sections being part of a compression-pumping system.

It is characterized in that it comprises at least the following stages:

a) separating the multiphase fluid into an essentially gaseous phase and an essentially s liquid phase, b) determining the liquid or liquid-gas interface level L in the separation device, c) comparing level L with a threshold value $L_0$, if L is greater than $L_0$, one acts on a series of means for controlling the flow rate of the liquid and gas phases so as to shift the alternating compression-pumping section of the alternating compression-pumping system from an operating mode $P_1$ for an essentially gaseous fluid to an operating mode $P_2$ for an essentially liquid fluid, by closing nearly totally control means Vg3, by opening nearly totally control means Vl3 so as to drive the liquid towards the compression section and by opening control means Vl4, d) level L is permanently controlled, as soon as level L becomes lower than a threshold level $L_2$, one acts on the flow rate control means so as to shift the compression section from mode $P_2$ to mode $P_1$, by opening nearly totally control means Vg3, by closing nearly totally control means Vl3 so as to drive the gas towards the compression section and by closing control means Vl4.

When shifting from mode $P_1$ to mode $P_2$, the initial rotating speed $N_{P1}$ can be varied to obtain a rotating speed $N_{P2}$, rotating speed $N_{P2}$ being so selected that the pressure value at the discharge end of the compression section obtained on passage of a gaseous fluid is substantially identical to the discharge pressure value when a liquid fluid flows through the section, and the rotating speed can be conversely varied when shifting from mode $P_2$ to mode $P_1$.

The stage of separation of the liquid droplets from the gas phase is continued in a compression stage arranged in the neighbourhood of the alternating compression-pumping section.

According to an embodiment of the process, when value L is lower than $L_4$, a majority of the liquid fraction coming from the pumping section is for example recycled to separation stage a).

According to another embodiment, at least a fraction of the gas phase coming from the compression section is for example recycled to the separation device so as to maintain a minimum flow of fluid in the compression section. The separation stage is for example carried out in a separation device.

The system and the process according to the invention are used for example to transfer a certain energy to the liquid phase and to the gas phase of a petroleum effluent.

They can also be used to transfer a certain energy to the liquid phase and to the gas phase of a wet gas such as a condensate gas or an associated gas.

The invention more generally relates to an alternating compression-pumping system allowing to impart energy to one or more fluids, said fluids can be liquid or gaseous.

It is characterized in that it comprises in combination at least the following elements:

at least one alternating compression section, suited to impart a pressure value to an essentially liquid fluid or to an essentially gaseous fluid, the compression section comprising at least one line for delivering an essentially liquid fluid, at least one line for delivering an essentially gaseous fluid, at least one line intended for discharge of a fluid that has acquired a certain energy value by passing through the compression section and at least one line intended for discharge of an essentially liquid fluid, means allowing to determine the nature of the fluid flowing into the system, these means being arranged upstream from the system, means allowing to control the flow rate of the liquid or of the gas, control means allowing to vary the state of the flow rate control means so as to shift the compression section from an operating mode suited to gas to an operating mode for liquid and vice versa.

The invention also relates to an associated process allowing to impart energy to a fluid that can be either essentially liquid or essentially gaseous.

It is characterized in that it comprises at least the following stages:

a) determining the nature of the fluid to which energy is to be imparted, b) sending the fluid, whatever its nature, to an alternating compression-pumping section, c) adjusting, during stage b), the alternating compression-pumping section to fluid compression when the fluid is essentially gaseous or to fluid pumping when the fluid is essentially liquid.

During the process, the rotating speed of the alternating compression-pumping section is for example adjusted.

Using the system according to the invention notably affords the following advantages:

reduction in the number of machines in relation to rotodynamic single-phase and multiphase machine, as well as size and weight reduction in relation to positive-displacement machines, power consumption reduction in relation to rotodynamic multiphase machines.

BRIEF DESCRIPTION OF THE DRAWINGS

Other features and advantages of the device according to the invention will be clear from reading the description hereafter of a non limitative example, with reference to the accompanying drawings wherein.

DETAILED DESCRIPTION

Figure 1:
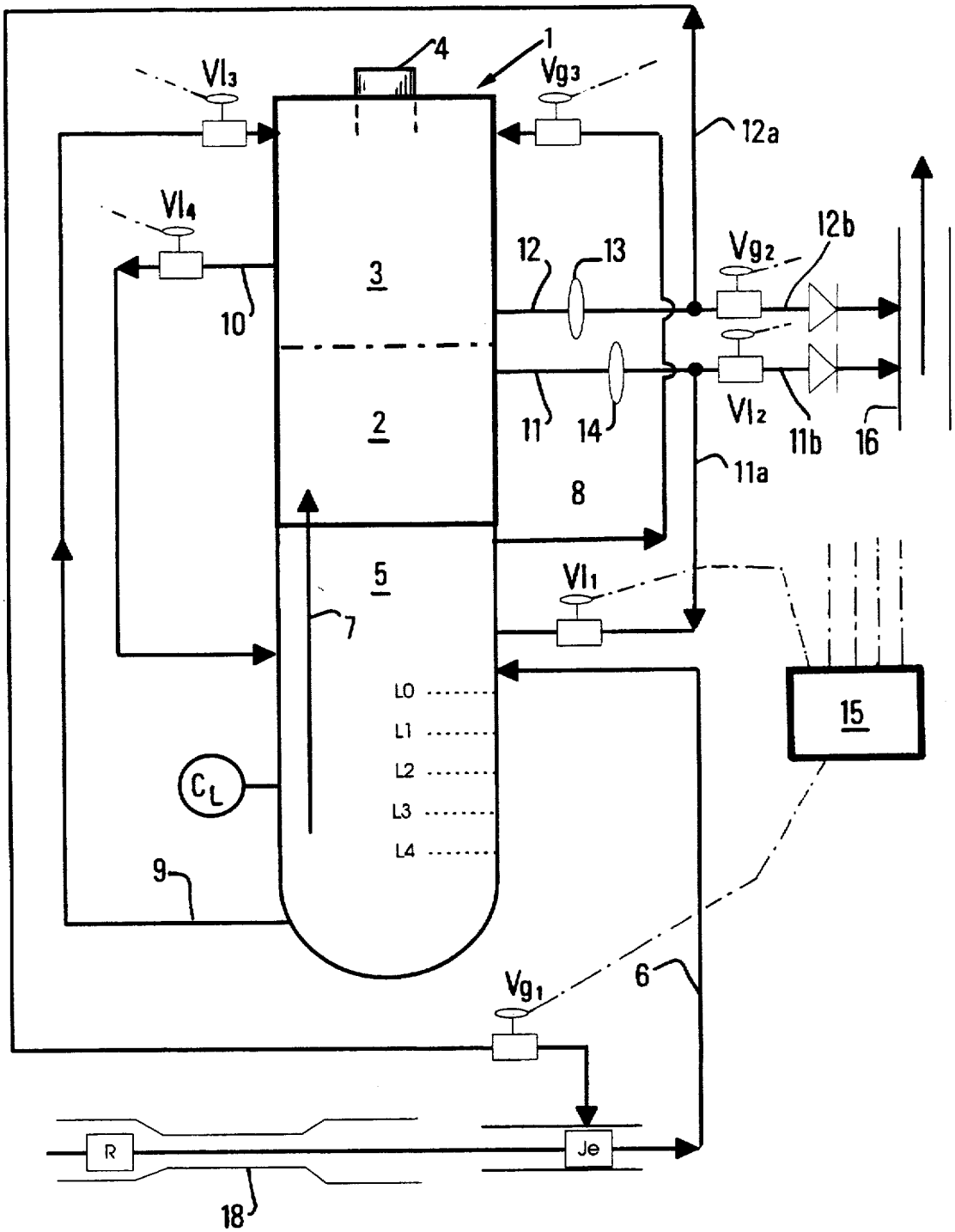
FIG. 1 diagrammatically shows an example of a two-phase compression system according to the invention, and the operating mode thereof, FIG. 2 diagrammatically shows an example of a valve opening and closing sequence according to the evolution of the liquid level in the separator.

FIG. 1 shows an example of an embodiment for the compression-pumping system comprising the specific features of the invention, given by way of non limitative example in order to allow better understanding of the working principle.

This system allows to raise the pressure of a multiphase fluid and notably the pressure for each of the phases that constitute it.

The expression "gas phase" is used to designate an essentially gaseous fluid or a gas resulting from the separation of the multiphase fluid, and the expression "liquid phase" designates an essentially liquid fluid or a liquid.

The alternating compression-pumping system is for example included in a single enclosure or housing 1. It comprises at least one pumping section 2 suited to an essentially liquid fluid and at least one compression section 3 whose technical characteristics are suited to an essentially gaseous fluid but which can also work for an essentially liquid fluid. The compression section is referred to as "alternating pumping section" for simplification reasons.

Each one of compression sections 3 or of pumping sections 2 comprises several stages consisting of impellers followed by diffusers. These impellers and diffusers are selected from those commonly used for pumping and compression of fluids comprising several phases or single-phase fluids.

Compression section 3 can comprise one or more inlet stages suited for finalizing separation of the multiphase fluid according to conventional methods used by the man skilled in the art. This embodiment is advantageous when the gas comprises liquid droplets, even in small amounts.

The impellers of compression section 3 and of pumping section 2 are for example secured to a single shaft 4. These two sections 2, 3 are separated by seal means 19 (FIG. 4A) allowing to prevent migration of the phases between the sections.

Without departing from the scope of the invention, these sections can also be, for example, separate and distinct sections secured to a single shaft.

It also comprises a separation device 5 included in housing 1 for example. According to other realization variants, the separator can be secured to or separate from the housing.

Housing 1 and separator 5 are provided with several lines intended for delivery, extraction or transfer of the essentially two-phase (gas-liquid) or essentially single-phase (gas or liquid) phases, for example:

- at least one line 6 intended for delivery of the multiphase fluid to be compressed (to which a certain energy value is to be imparted),
- at least one line 7 for transfer of the essentially liquid phase, connecting separator 5 and pumping section 2 (connection in the neighbourhood of the first inlet stage of the pumping section for example),
- at least one line 8 for extraction of the essentially gaseous phase, preferably arranged in the upper part of separator 5, and connected for example to the inlet of compression section 3. Line 8 is for example equipped with an on-off valve Vg3 situated as close as possible to the inlet of the inlet stage of the compression section,
- at least one line 9 for extraction of the essentially liquid phase, arranged in the neighbourhood of separator 5, preferably in the lower part thereof, and connected to the inlet of compression section 3. This line 9 is equipped with on-off valves Vl3 situated as close as possible to the inlet of the compression section,
- lines 8 and 9 can open into the same inlet stage of the compression section, for example in a single volute (not shown in the figure for simplification reasons, but known to the man skilled in the art),
- at least one line 10 for extraction of the essentially liquid phase that has acquired a certain energy by passing through the alternating compression-pumping section, line 10 can be equipped with a valve Vl4,
- a line 11 for discharge of the essentially liquid phase that has acquired energy through pumping section 2, placed at the outlet of pumping section 2.

Line 11 can divide into two lines 11*a*, 11*b*.

Line 11*a* is equipped with a regulating valve Vl and allows to recycle at least a fraction of the essentially liquid phase to separator 5. This fraction of liquid can come from an external source of liquid connected to line 11*a* without departing from the scope of the invention.

Line 11*b* is for example provided with a regulating valve Vl2 allowing to transfer an amount of liquid to another place. Line 11 can possibly be equipped with a flow metering device 14;

- a line 12 for discharge of the essentially gaseous phase arranged at the outlet of compression section 3.

Line 12 is for example provided with a flow metering device 13.

This line divides for example into two lines 12*a*, 12*b*.

Line 12*a* is provided with a regulating valve Vg1 that allows to recycle a fraction of the compressed gas to the delivery line so as to reintroduce it into the separator. This recycle circuit acts as a protection circuit for the compression section.

Line 12*b* comprises for example a valve Vg2 allowing discharge of the gas.

The protection circuit (12*a*, Vg1) allows to maintain a minimum flow rate so as to protect the system against highly destructive flow fluctuations at a reduced flow rate. One of the ways allowing to implement it is given in the description hereafter.

The recycle system (11*a*, Vl1) allows to maintain a minimum liquid flow rate so as to protect the alternating compression-pumping system against vibrations generated at reduced flow rate.

Lines 11*b* and 12*b* can be joined into a single line 16 to discharge the fluid to a destination or a processing site.

Separator 5 and the various lines mentioned above are possibly equipped with means allowing to determine the pressure and the temperature, such as detectors $C_P$, $C_T$, not shown in the figure for simplification reasons.

The alternating compression-pumping system also comprises a means for determining the rotating speed N of shaft 4 supporting the impellers of the compression and pumping sections.

Separator 5 is equipped with means, for example one or more detectors $C_L$, for determining the level of the liquid-gas interface. This or these detectors are advantageously capable of following the evolution of the liquid level in the separator.

All the measuring devices are connected to a control system 15 capable of storing the various data, to process them and to send signals allowing to act on the various valves that equip the system according to a method an example of which is given hereafter.

Control system 15 is thus capable of driving the various operations given by way of non limitative example hereafter.

In order to describes the stages of the method implemented by means of this system, the following parameters are defined:

- a mean GLR value, referred to as GLRmo, that relates to a very long production time, for example of the order of a month. This value and the value of the total volume flow rate are used to dimension the valves and the impellers associated with the compression and pumping sections,
- according to an embodiment of the invention, two values for the rotating speed $N_{P1}$ and $N_{P2}$. These two values respectively correspond to the "normal or adjusted or optimized" working speeds when an essentially gaseous fluid flows through the compression section and when an essentially liquid fluid flows through the compression section, for example five values for threshold levels in the separator, $L_0$, $L_1$, $L_2$, $L_3$ and $L_4$. The evolution of the liquid level in the separator is "monitored" by the aforementioned level detector $C_L$, threshold level $L_3$ which is a regulation level around which it will preferably be sought to remain in order to avoid too frequent shifts for the compression and pumping sections, operating modes:

Mode $P_1$: a gas is flowing or about to flow through the compression section,

Mode $P_2$: a liquid is flowing or about to flow through the compression section.

Shifting from mode $P_1$ to mode $P_2$ is performed when the liquid level in the separator becomes higher than $L_0$. Shifting from mode $P_2$ to mode $P_1$ is performed when the liquid level in the separator becomes lower than $L_2$. Shifting from one operating mode to the other leads to a change in the states of the valves.

The change of state for the various valves can be as follows, level L is the level of the variable interface and it is monitored by level detector $C_L$ in the separator:

In order to better describe the various stages, we shall start at the time when the liquid-gas interface of the fluid introduced through line 6 is about level $L_3$.

OPERATION IN MODE $P_1$ AND SHIFT TO MODE $P_2$

Reference level $L_3$ being taken as the starting point, the open and closed positions or states of the various valves are as follows:

gas discharge valve Vg2 is totally open and gas recycle valve Vg1 is totally closed, liquid recycle valve Vl1 is partly open. Liquid discharge valve Vl2 is partly closed, the closing degree increasing with the GLRmo value so as to prevent a sudden and relatively considerable liquid inflow (in relation to normal operating conditions). Thus, for a GLRmo value of the order of 10 for example, it will not be necessary to oversize valve Vl2, whereas for a greater value (respectively much greater), it will be advisable to slightly (respectively greatly) oversize the maximum opening of this valve in relation to the normal production of liquid, gas and liquid discharge valves Vg3 and Vl3 are totally open and closed respectively, liquid extraction valve Vl4 is totally closed.

The system remains in this state as long as the liquid-gas interface remains close to threshold value $L_3$; this is controlled for example by means of level detector $C_L$. The fluid sent to the compression section is an essentially gaseous fluid.

In the case where the composition of the fluid from line 6 varies in such a way that the amount of liquid will lead to choking of the separator, control system 15 will act on the various valves so as to shift the compression-pumping section from an operating mode for gas to an operating mode for liquid, and therefore an essentially liquid fluid will pass into the compression section. This corresponds to the shift from operating mode $P_1$ to operating mode $P_2$, that can be performed by taking account of one or more intermediate reference levels, for instance, in the example given hereunder by way of non limitative example, two intermediate levels $L_2$ and $L_1$, and therefore intermediate changes in the state of the valves.

When level L becomes higher than $L_3$, control system 15 acts so that valve Vl1 gradually closes and valve Vl2 gradually opens. The opening thereof is subjected to a PID type mode or to any other regulation mode known to the man skilled in the art. When level L becomes lower than $L_3$, the reverse process applies.

Figure 2:
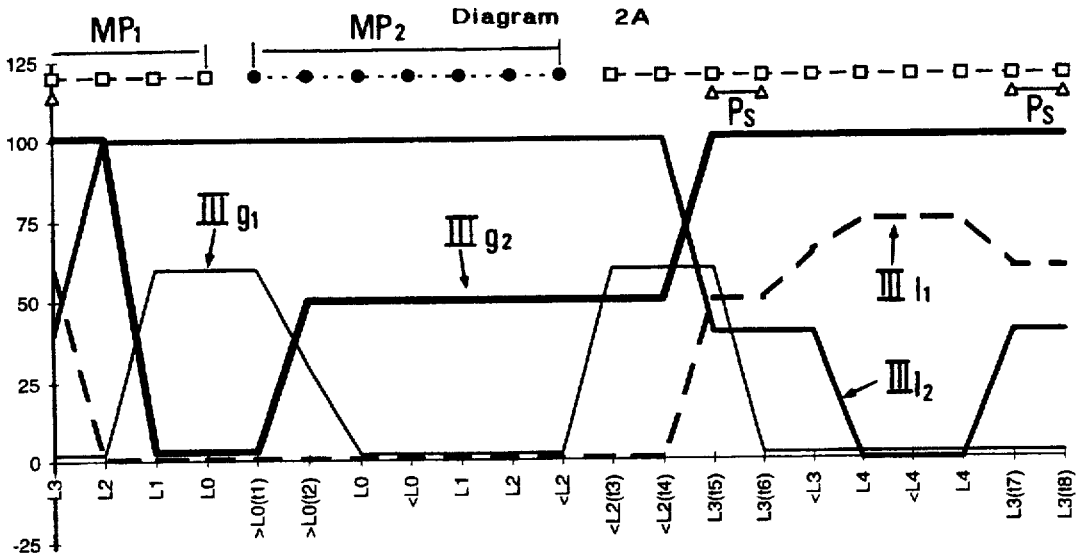
Figure 2:
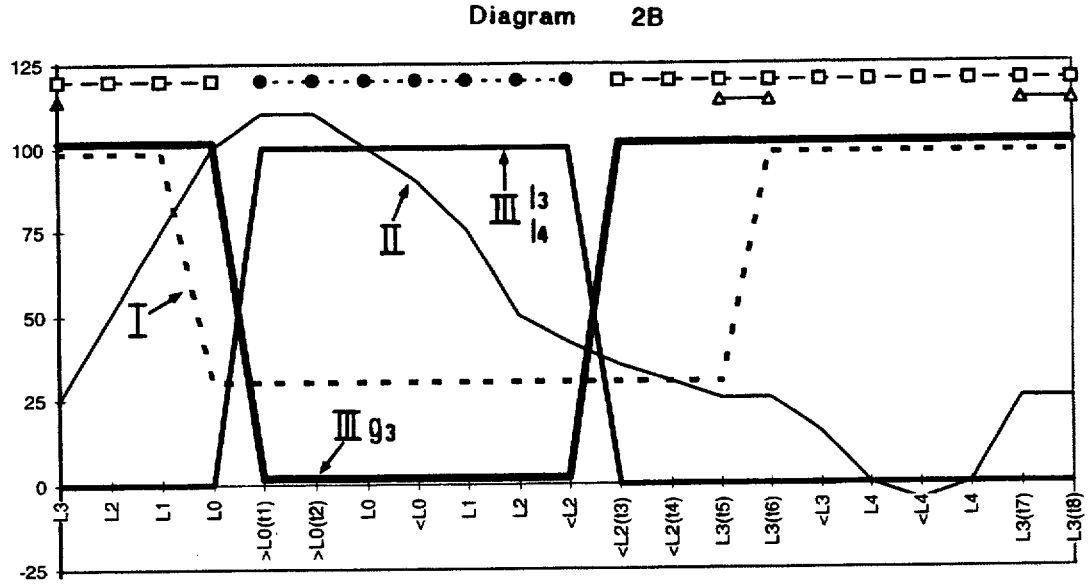

The evolution of the state of the valves can be seen in diagrams 2A and 2B of FIG. 2.

FIG. 2 diagrammatically shows an example of an opening and closing sequence of valves Vl1, Vl2, Vg1, Vg2, Vg3, Vl3 and Vl4 as a function of the evolution of the liquid level in the separator, for a shifting sequence comprising shifting from operating mode $P_1$ to mode $P_2$ and conversely from mode $P_2$ to mode $P_1$. The diagrams are shown in the form of two charts 2A and 2B showing the state of valves Vl1, Vl2, Vg1, Vg2 and Vg3, Vl3 and Vl4, whose evolution is shown by curves (III)gi and (III)li, numerals i corresponding to the number of the valves, and letters g and l to the gas phase and to the liquid phase.

The evolution of the interface level in the separator is laid off as abscissa, and as ordinate:

Curve I: the rotating speed, on the ordinate scale index 0 corresponds to a zero rotating speed and index 100 to a nominal rotating speed, Curve II: the level of liquid in the separator (0:level L4; 100:level L0), and Curves (III)gi and (III)li the opening degree of the valves for the gas (index gi) and for the liquid (index li), on the scale 0 corresponds to the closing of the valves and 100 to the opening of the valves.

References MP1, MP2 and PS correspond to operation in mode $P_1$, $P_2$ or in mode $P_1$ stabilized around level $L_3$.

The evolution of the state of the valves for implementing the process can be as follows:

When level L becomes higher than $L_2$, the control system acts to close at least partly valve Vg2, to open partly valve Vg1, to totally close valve Vl1 and to totally open valve Vl2 (see diagram 2A in FIG. 2). Closing of the valve can be obtained by following a substantially linear law.

As the level L of the liquid-gas interface continues to rise in the separator, as soon as it becomes higher than $L_1$, control system 15 acts totally close valve Vg2 so as to prevent a liquid phase inflow in the compression section, and to open valve Vg1 in order to maintain a higher gas flow rate than the minimum flow rate in the compression section allowing to ensure smooth running of the compression section.

Furthermore, the rotating speed can be reduced according to a substantially linear law.

During the two stages described above, the control system, by acting on the valves, has positioned these valves in intermediate states (or preliminary states) in relation to the state in which they have to be for shifting from operating mode $P_1$ to operating mode $P_2$.

This shift is started when level L becomes higher than $L_0$. Control system 15 acts to reduce the rotating speed down to rotating speed $N_{P2}$ and to totally close valve Vg3, to totally open valve Vl3 so as to drive the liquid towards the compression section an to open valve Vl4 (reference>L0(t1) in diagram 2B of FIG. 2). Shifting being completed, compression-pumping system 15 will open valve Vg2 so as to discharge the liquid through the compression section, and totally close valve Vg1 (reference>LO(t2) in diagram 2B of FIG. 2).

Figure 3:
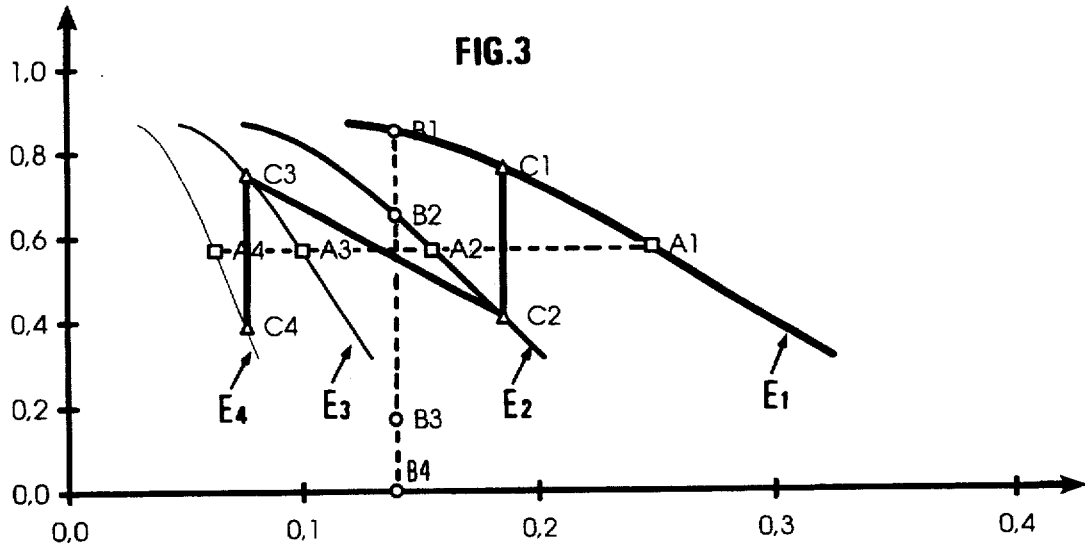
FIG. 3 shows the hydraulic performances of a series of impellers suited for compression of a gas and a means allowing to limit their maladjustment to an incompressible phase.

Opening of valve Vl4 allows to limit maladjustment of the compression stages during operation with a very little compressible phase (essentially liquid phase), as shown in FIG. 3.

In mode $P_1$, the liquid inflow rate can be insufficient to maintain the liquid level at level $L_3$. When level L becomes lower than $L_4$, control system 15 acts so as to totally close valve Vl2, in order to prevent a gas phase inflow in the liquid section and to increase the opening of valve Vl1, so as to allow operation at a higher flow rate than the minimum flow rate below which vibrations appear. This operating mode is maintained as long as the liquid level is lower than $L_4$. When the liquid level becomes higher than $L_3$, valve Vl2 takes the opening position corresponding to a normal operation condition and opening of valve Vl1 is adjusted so as to regulate the liquid level around $L_3$.

Shift from Mode $P_1$ to Mode $P_2$ and Operation During a Period of Time in Mode $P_2$ In operating mode $P_2$, an essentially liquid phase, therefore having a high density, flows through the compression section. The compression rate can then be very high or even too high in relation to the mechanical resistance of the impellers, of the housing and of the commonly used equipment situated downstream from the housing. Advantageously, rotating speed $N_{P2}$ is so selected that the delivery pressure is approximately equal to that obtained in mode $P_1$, considering the density of each phase, and so that $N_{P2}<N_{P1}$.

The positions of the valves and the rotating speed are maintained in the state reached after shifting as long as the level remains higher than $L_2$, so as to prevent too frequent mode changes, for example when shifts from $P_1$ to $P_2$ and from $P_2$ to $P_1$ are triggered by the same liquid level.

Shift from Mode $P_2$ to Mode $P_1$

When level L becomes lower than $L_2$, the control system starts progressive shifting of the compression system from operating mode $P_2$ to mode $P_1$.

The first shift stage (diagram 2B in FIG. 2<L2(t3)) consist in totally opening valve Vg3, in partly opening valve Vg1 and in closing valves Vl3 and Vl4 so as to drive the gaseous fluid contained in the separator towards the compression section.

Once this operation completed (diagram 2B in FIG. 2–L2(t4)), the control system acts to open valve Vg2 (nearly totally, L3(t5)) so as to allow discharge of the gas when the pressure at the outlet of the compression section reaches a higher pressure than the pressure measured downstream from junction Js, to bring valve Vl2 back to an open position substantially identical to the position corresponding to the normal operating case defined above and to open valve Vl1 so as to allow the liquid level to be maintained around $L_3$. At L3(t5), valve Vg1 starts to close.

After a time of the order of some minutes, the control system acts to totally close valve Vg1 (diagram 2A in FIG. L3(t6)) and to bring the value of the rotating speed back to a value corresponding substantially to value $N_{P1}$ (mode $P_1$). However, opening of valve Vg1 is maintained in such a state that the flow rate of gas is higher than the flow rate corresponding to the allowable minimum flow rate (antipumping protection). This flow rate value is specified in relation to the characteristics of the compression section.

FIG. 3 shows, in a flow rate coefficient (abscissa)—pressure coefficient (ordinate) diagram, the evolution of working points of the alternating compression-pumping section when the compression-pumping system is equipped with means allowing to adjust at least one series of compression staged to pumping of a liquid, knowing that these compression stages have been initially selected in relation to an essentially gaseous fluid. These means are for instance, in the present example, one or more extraction lines equipped with valves allowing to control passage of fluids.

Curves Ei are the characteristic curves of the compression-pumping system, i being the number of the compression stage.

Points Ai correspond to the working point for a compressible phase, points Ci to the evolution, on the characteristic curves, of the working point for pumping of a liquid with an extraction stage, points Bi to the evolution of the working point for pumping of a liquid when there is no extraction stage.

Within the scope of the present invention, the term "adjustment" of a stage refers to the operation of a stage at a flow rate corresponding to the highest-efficiency point, a point that is known to compression machine specialists. The flow rate and pressure coefficients of a stage are dimensionless quantities that are respectively proportional to the volume flow rate of the stage and to the manometric head, two parameters known to these specialists.

In the example given in connection with FIG. 3, the compression section is made up of four stages $E_1$ to $E_4$.

When the compression section works with an essentially gaseous fluid, adjustment of the stages is shown by points $A_1$ to $A_4$, the volume flow rates decreasing between the first and the last stage, considering the compressibility of the gas.

When the compression section works with a liquid, without making technical alterations in relation to the characteristics selected for the gas, operation of the first stage at point $B_1$ leads to operation of the next stages at points $B_2$, $B_3$ and $B_4$ respectively. If a stage is sometimes wheel-adjusted, stage $E_2$ (point $B_2$), the stages situated upstream and downstream from this stage are generally very badly adjusted. Thus, the stages $E_1$ and $E_3$ will have very low efficiencies, and they will generate temperature rises and flow fluctuations. As for stage $E_4$ (point $B_4$), it will reduce the energy supplied to the fluid (compression ratio below 1) by stages $E_1$ to $E_3$.

It is possible to adjust a series of stages (initially adjusted to compression of a gas) for pumping of a liquid by extracting part of the liquid downstream from one or more stages, the flow extracted being sent back to separator 5.

The compression system according to the invention therefore comprises at least one extraction line 10 arranged between two compression stages and a valve Vl4. The fluid fraction extracted from the compression section can be sent to separator 5 or to a point external to the compression-pumping system according to the invention.

FIG. 3 thus shows the case where an extraction is performed downstream from second stage $E_2$, in order to obtain an operation according to points $C_1$ to $C_4$ close to the optimum working point. Adjustment of the compression section can be perfected for operation with a liquid fluid by increasing the number of extractions. Thus, by performing three extractions downstream from stages $E_1$ to $E_3$, it will be possible to operate the stages at points $A_1$ to $A_4$ with a liquid.

The flow of liquid extracted is determined by suitable dimensioning of extraction lone 10 (length and diameter), or by arranging an energy dissipative device known to the man skilled in the art (restriction, orifice, on-off valve) in this line.

Figure 4B:
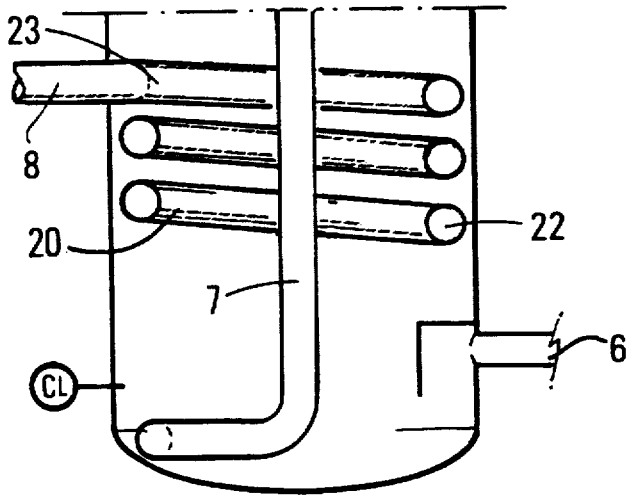
FIGS. 4A and 4B show a variant of the compression system described in FIG. 1, FIG. 5 diagrammatically shows a more general embodiment for the compression-pumping system.

FIG. 4 shows a realization variant comprising means allowing to optimize the fluid separation stage.

This variant comprises a static separator 5 of reduced volume by comparison with the dimensions of conventionally used separators upstream from single-phase machines.

The separator alone performs rough separation of the phases by the simple action of gravity. Separation of the phases can be improved by rotating the essentially gaseous and liquid phases in separator 5.

Rotation can be obtained for example by arranging the inlets of lines (7, 8, 9) tangentially in relation to the wall of separator 5 and substantially perpendicular to the axis of symmetry of the separator (at the centre of symmetry of the separator) (not shown in FIG. 4) as described in the claimant's patent application FR-98/00,933. The inlets of lines 7 and 9 are situated below level $L_4$, whereas the inlet of line 8 is situated above level $L_0$.

Figure 4A:
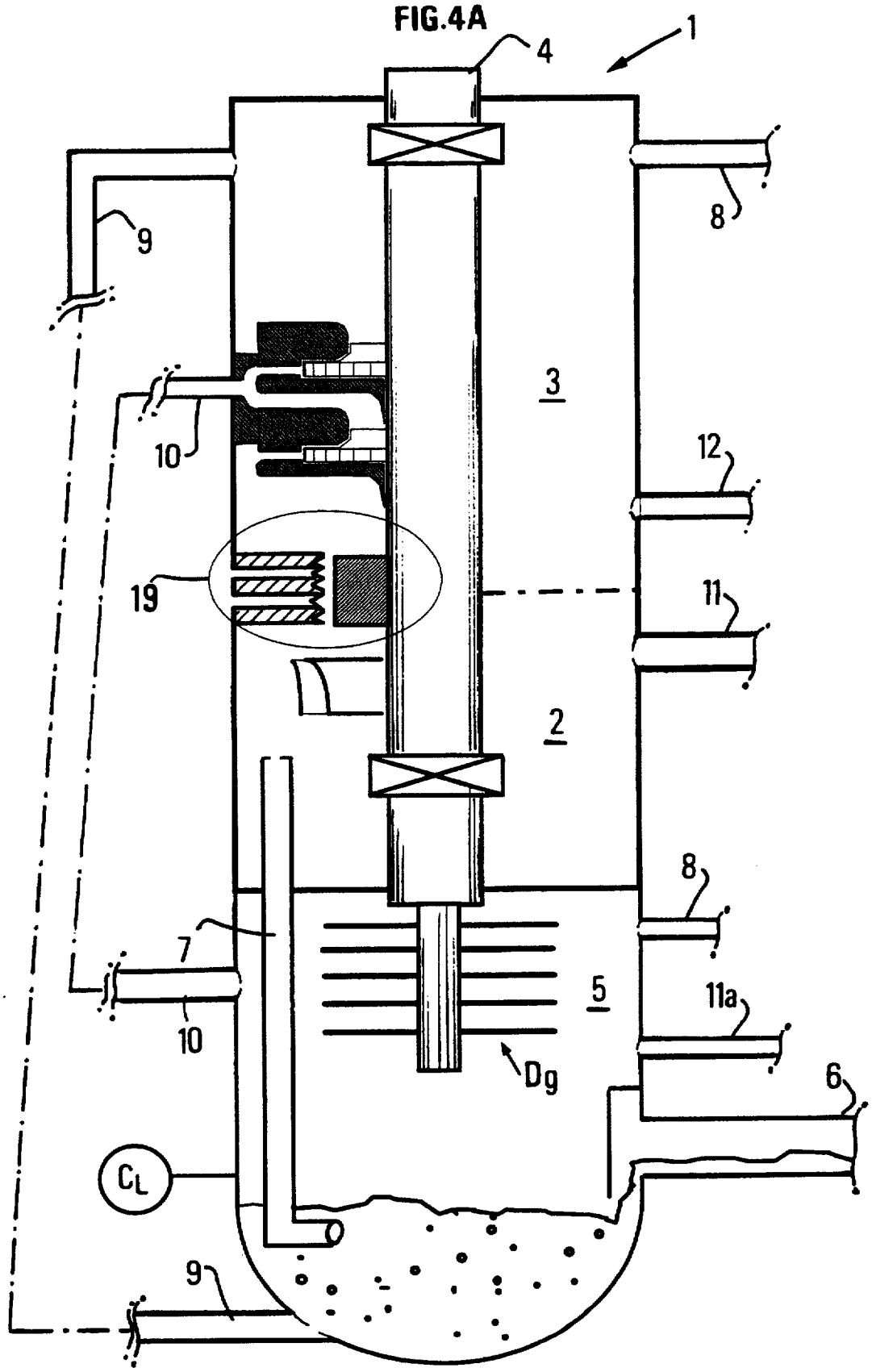

Fine separation of the droplets contained in the gas phase can be obtained by dynamic or static separation:

Dynamic Separation can be Performed by a Layout of Several Elements Such as those Described in FIG. 4A by placing rotating disks Dg in the upper part of separating drum 5, for example above level $L_0$.

In this example, rotating shaft 4 common to pumping section 2 and compression section 3 stretches into static separator 5 of FIG. 4A and serves as a support for the series of disks.

Rotation of the disks causes rotation of the gas phase in the separator. Under the effect of the centrifugal forces thus generated, the heavier droplets swerve towards the inner wall of the separator.

The diameter of shaft 4 or of part of this shaft supporting disks Dg is dimensioned according to the torque to be transmitted and to the required stiffness. The shaft can consist of several elements connected by geared coupling, flexible coupling, magnetic or other coupling.

Disks Dg are for example arranged so as to prevent operation of the disks in the neighbourhood of the oil-gas interface and emulsion formation.

The diameter of these disks and the distance between the disks of a single series can be determined according to the desired degree of separation upstream from the pumping and compression sections. For example, these parameters can be determined according to the limit diameters for the droplets. These parameters can be calculated by means of a three-dimensional calculation code available for the man skilled in the art.

Static Separation can be Performed by using an ascending helical line (FIG. 4B) with a small radius of curvature, upstream from line 8, as detailed in the aforementioned patent application.

In this figure, a helical line 20 is arranged around line 7 allowing passage of the liquid phase towards the pumping section, and that is situated substantially in the neighbourhood of the central axis of the separator. The gas containing the liquid droplets flows in through inlet 22. As it moves through the helical line, the droplets settle along the wall of the line by the action of a centrifugal force. The line being ascending in this non limitative realization example, the deposited liquid falls back into the separator through gas inlet 22 whereas the gas flows out at point 23 (inlet of line 8). The characteristics of the helical tube (tube diameter, helix radius and helix slope) are dimensioned so as to allow the deposited liquid to fall back through inlet 22.

Seal device 19 shown in FIG. 4A allows to prevent migration of the phases between the compression and the pumping sections. An example of such a device is detailed in the aforementioned patent application FR-98/00,933, whose technical teaching relative to this seal device is incorporated by reference.

The reliability of the level measurement in the separator being essential for protection of the rotating elements, level measurement can for example be performed by means of three detectors working according to the principle of a majority logic (when a detector supplies information different from that provided by the two others, the information supplied by the first detector is dismissed in favour of the two others).

In mode $P_1$, lines 12*a* and 11*a* can also be used in order to avoid operation of the compression section and of the pumping section in the reduced flow rate zone, which may lead to fast damaging of the compression section (antipumping) and generate pressure fluctuations and vibrations in the pumping section.

In order to anticipate the inflow of a liquid plug or of a considerable volume of is liquid and to ensure better protection of the multiphase production equipment, a system for measuring the liquid ratio and the velocity of displacement thereof can be installed upstream from the equipment, so as to anticipate actions on the valves and on the velocity regulation.

Regulation by fuzzy logic taking account of a great number of parameters (for example, the liquid level in the separating drum, the opening degree of the valves, the liquid ratio and its velocity of displacement upstream from the compression-pumping system) can be used in order to allow better production optimization in relation to conventional regulation while providing better protection for the equipment.

The working principles of a majority logic, of a fuzzy logic, of a protection against a minimum flow rate, of a liquid ratio and velocity measurement in a pipe are known to the man skilled in the art.

The two-phase compression device can be preceded by a liquid plug moderator 18 (FIG. 1) in order to limit choking risks for the separating drum and therefore to limit the number of shifts from one mode to the other.

This moderator is for example situated upstream from the junction of lines 6 and 12*a*. It works according to the principle of an increase in the pressure drops for a single velocity of flow when the liquid ratio increases and of an intensification of this effect at a short distance from the inlet of the two-phase compression device. The moderator can consist of a diameter restriction, an orifice, a valve or any other device that can cause a pressure drop.

In detail, the moderator will react with the rotodynamic two-phase compression system as follows: for a given rotating speed and a given delivery pressure, a pressure drop increase, an intake pressure decrease and a compression ratio increase will correspond to a liquid ratio increase at the inlet of the two-phase compression device. With a rotodynamic machine, at a given rotating speed, a compression ratio increase leads to a decrease in the volume flow rate at the inlet and consequently to a decrease in the velocity of flow in moderator 18.

This effect is illustrated in the tables hereafter for two distinct operating instances and with the following hypotheses: constant rotating speed and delivery pressure.

Case No.1: Conditions at the inlet of the two-phase device (for GLR=1000): pressure=2.5 MPa abs, total volume flow rate=12000 $m^3$/hr and pipe diameter=16 inches.

| | | | | | | |
|---|---|---|---|---|---|---|
| Input GLR | 1000 | 60 | 17 | 8 | 5 | <5 |
| Pressure drop (1) | 0.035 | 0.06 | 0.11 | 0.18 | 0.26 | >0.26 |
| Gas flow rate alone (2) | 12000 | 11400 | 10800 | 9400 | 7000 | 0 (3) |
| Gas + liquid flow rate (2) | 12000 | 11600 | 11400 | 10600 | 8400 | 0 (3) |

(1) pressure drops (MPa) corresponding to a flow rate of 12000 $m^3$/hr.

(2) resulting flow rates ($m^3$/hr) in the compression section and the two-phase compression device considering the pressure drops in the moderator and the characteristics of the compression section (manometric head according to the volume flow rate).

(3) when the volume flow rate of gas at the inlet of section 3 tends to become lower than the minimum flow rate (antipumping protection), the recycling valve opens and the delivery pressure delivered by the compressor becomes lower than the pressure of the network, preventing discharge of the gas in the network and leading to a temporary production stop upstream and downstream from the compressor.

Case No.2: Conditions at the inlet of the two-phase device (for GLR=1000): pressure=1 NPa abs, total volume flow rate=12000 $m^3$/hr and pipe diameter=16 inches.

| | | | | | |
|---|---|---|---|---|---|
| Input GLR | 1000 | 29 | 17 | 11 | <11 |
| Pressure drop (1) | 0.014 | 0.059 | 0.091 | 0.129 | >0.129 |
| Gas flow rate alone (2) | 12000 | 10300 | 8600 | 7000 | 0 (3) |
| Gas + liquid flow rate (2) | 12000 | 10600 | 9100 | 7600 | 0 (3) |

During actual working, a decrease in the gas production progressively leads to a decrease in the pressure of the network in the neighbourhood of the compressor discharge end, thus allowing higher absorption of the flow of gas, hence a lesser production slowdown than that shown in the tables above.

In the case where the rotating speed is controlled by the delivery pressure, a decrease in this pressure leads to an increase in the rotating speed and a local flow acceleration in the neighbourhood of the compressor, hence a lesser production slowdown than that shown in the tables above.

However, whatever the dynamic range of the network and the speed regulation mode selected for the compressor, the moderator situated upstream allows in any case a pressure drop increase and consequently a decrease in the input volume flow rate when the GLR decreases.

Figure 5:
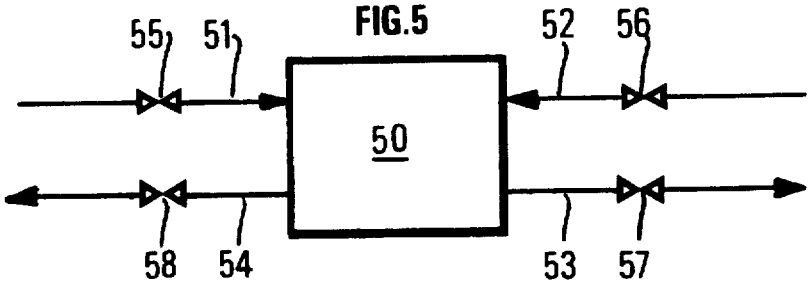

FIG. 5 diagrammatically shows an alternating compression-pumping system suited for example for all the ranges of application where energy is to be imparted to several fluids, one being essentially liquid and the other essentially gaseous.

In this case, the alternating compression-pumping system comprises an alternating gas-liquid compression section 50 having one of the characteristics of the compression-pumping section described in FIG. 1.

Two delivery lines (51, 52) are for example provided, one for delivery of the liquid fluid and the other for delivery of the gas.

Means allowing to determine upstream the nature of the fluid flowing into the compression system, arranged for example on the delivery lines.

A discharge line 53 for the fluid that has acquired energy.

A line 54 intended for discharge of an essentially liquid fluid, most of the liquid being discharged through line 53 after acquiring energy, the rest passing through line 54 so as to allow adjustment of the compression section to passage of the liquid.

Control means substantially identical to means 15 described above. These means notably take account of the result of the determination of the incoming fluid for controlling the shift of the compression-pumping section into mode $P_1$ or mode $P_2$.

Means such as valves 55, 56, 57 and 58 arranged respectively on lines 51, 52, 53 and 54. These valves allow passage or not of the essentially liquid fluid or of the essentially gaseous fluid towards the alternating compression section or from the alternating compression section.

What is claimed is:

1. An alternating compression-pumping system for allowing to impart energy to a multiphase fluid whose composition is variable with time, comprising in combination the following elements:

at least one alternating compression-pumping section suited to impart a pressure value to an essentially liquid fluid or to an essentially gaseous fluid, said compression-pumping section comprising at least one line intended for delivery of an essentially liquid phase, at least one line intended for delivery of an essentially gaseous phase, at least one line intended for discharge of a gas that has acquired a certain energy after passing through the system, and at least one line intended for discharge of a liquid that has acquired a certain energy after passing through the compression-pumping section, at least one pumping section selected to impart energy to an essentially liquid fluid, said pumping section comprising at least one line intended for delivery of an essentially liquid phase and at least one line intended for discharge of the liquid phase pumped, at least one separation device for separating the various phases forming the multiphase fluid, said separation device being connected to a multiphase fluid delivery line and to the at least one line intended for discharge of the liquid coming from the alternating compression-pumping section, said separation device comprising at least one gas phase discharge line and at least one liquid phase discharge line, said separation device is provided with means allowing to detect the gas-liquid interface level of the fluid introduced in separation device, means allowing to control the flow rate of the liquid and gas phases in the various lines, control means allowing to vary the state of said flow rate control means so as to shift the compression section from an operating mode suited for gas to an operating mode suited for liquid and vice versa.

2. A compression system as claimed in claim 1, comprising at least one line for recycling at least a fraction of the essentially gaseous fluid from the compression pumping section to the separation device.

3. A compression system as claimed in claim 1, comprising at least one line for recycling at least a fraction of the essentially liquid fluid from the pumping section to the separation device.

4. A compression system as claimed in claim 1, characterized in that the separation device is associated with at least one of the following elements:

a helical line intended for separation of the liquid droplets from the gas phase, a series of disks mounted on a shaft, said shaft extending in said separation device.

5. A system as claimed in claim 1, characterized in that the compression section comprises at least one stage allowing to obtain separation of the gas phase and of the liquid phase occurring in the form of droplets.

6. A process allowing to impart energy to each of the phases of a multiphase fluid comprising at least a liquid phase and at least a gas phase, the amount of the essentially liquid phase and the amount of the essentially gaseous phase being variable with time, said gas phase being sent to an alternating compression-pumping section and said liquid phase being sent to a pumping section or to said alternating compression-pumping section, the sections being part of an alternating compression-pumping system, characterized in that it comprises at least the following stages:

a) separating said multiphase fluid into an essentially gaseous phase and an essentially liquid phase, b) determining the level L of liquid or of the liquid-gas interface in a separation device, c) comparing level L with a threshold value $L_0$, if L is above $L_0$, one acts on a series of means controlling the flow rate of the liquid and gas phases so as to shift the alternating compression-pumping section of said alternating compression-pumping system from an operating mode $P_1$ for an essentially gaseous fluid to an operating mode $P_2$ for an essentially liquid fluid and to drive the liquid towards the compression section d) level L is permanently controlled, as soon as level L becomes lower than a threshold value $L_2$, one acts on the flow rate control means to shift the compression section from mode $P_2$ to mode $P_1$ and to drive the gas towards the compression section.

7. A process as claimed in claim 6, characterized in that the initial rotating speed $N_{P1}$ is varied to obtain a rotating speed $N_{P2}$ when shifting from mode $P_1$ to mode $P_2$, said rotating speed $N_{P2}$ being so selected that the value of the delivery pressure of the compression section obtained on passage of a gaseous fluid is substantially identical to the value of the delivery pressure when a liquid fluid flows through the section, and the rotating speed can be conversely varied when shifting from mode $P_2$ to mode $P_1$.

8. A process as claimed in claim 6, characterized in that separation of the liquid droplets from the gas phase is continued in a compression stage situated in the neighbourhood of the alternating compression-pumping section.

9. A process as claimed in claim 6, characterized in that, if the value of L is below $L_4$, a majority of the liquid fraction coming from the pumping section is recycled to separation stage a).

10. A process as claimed in claim 6, characterized in that at least a fraction of the gas phase coming from the compression section is recycled to the separation device so as to maintain a minimum flow rate of fluid in said compression section.

11. Use of the process as claimed in claim 6 for transferring a certain energy to the liquid phase and to the gas phase of a petroleum effluent.

12. Use of the process as claimed in claim 6 for transferring a certain energy to the liquid phase and to the gas phase of a wet gas, such as a condensate gas, or an associated gas.

13. An alternating compression-pumping system for allowing to impart energy to a fluid, said fluid being liquid or gaseous, comprising in combination at least the following element:

at least one alternating compress-ion pumping section suited to impart a pressure value to an essentially liquid fluid or to an essentially gaseous fluid, said compression-pumping section comprising at least one line intended to delivery of an essentially liquid fluid, at least one line intended for delivery of an essentially gaseous fluid, at least one line intended for discharge of a fluid that has acquired a certain energy value by passing through said compression section and at least one line intended for discharge of an essentially liquid fluid, means allowing to determine the nature of said fluid flowing into said system, said means being arranged upstream from said system, means allowing to control the flow rate of liquid or of gas, control allowing to vary the state of said flow rate control means so as to shift the compression section from an operating mode suited for gas to an operating mode suited for liquid and vice versa.

14. A process for imparting energy to a fluid that can be either essentially liquid or essentially gaseous, characterized in that it comprises at least the following stages:

a) determining the nature of the fluid to which energy is to be imparted, b) sending said fluid, whatever the nature thereof, to an alternating compression-pumping section, c) adjusting, during stage b), said alternating compression-pumping section to compression of a fluid when it is essentially gaseous or to pumping of a fluid when it is essentially liquid.

15. A process as claimed in claim 14, characterized in that the rotating speed of the alternating compression-pumping section is adjusted.

* * * * *